US005474441A

United States Patent [19]

Farrauto et al.

[11] Patent Number: 5,474,441

[45] Date of Patent: Dec. 12, 1995

[54] CATALYST CONFIGURATION FOR CATALYTIC COMBUSTION SYSTEMS

[75] Inventors: Robert J. Farrauto, Westfield; Jennifer S. Feeley, Clinton; Dianne O. Simone, Edison; Yiu K. Lui, Parlin; Teresa Kennelly, Belle Mead, all of N.J.

[73] Assignee: Engelhard Corporation, Iselin, N.J.

[21] Appl. No.: 22,248

[22] Filed: Feb. 25, 1993

Related U.S. Application Data

[63] Continuation-in-part of Ser. No. 852,371, Mar. 12, 1992, Pat. No. 5,216,875, which is a continuation-in-part of Ser. No. 776,907, Oct. 16, 1991, Pat. No. 5,214,912, which is a continuation-in-part of Ser. No. 465,678, Jan. 16, 1990, abandoned, which is a continuation-in-part of Ser. No. 234,660, Aug. 22, 1989, Pat. No. 4,893,465.

[51] Int. Cl.[6] ..... F23R 3/40; F23D 3/40

[52] U.S. Cl. ..... 431/7; 431/268; 431/267

[58] Field of Search ..... 431/268, 7; 60/39.822

[56] References Cited

U.S. PATENT DOCUMENTS

| | | |
|---|---|---|
| 3,056,646 | 6/1963 | Cohn . |
| 3,846,979 | 2/1974 | Pfefferle . |
| 3,919,120 | 11/1975 | Kato et al. . |
| 3,928,961 | 12/1975 | Pfefferle . |
| 3,940,923 | 3/1976 | Pfefferle . |
| 3,975,900 | 7/1976 | Pfefferle . |
| 3,993,572 | 11/1976 | Hindin et al. . |
| 4,019,316 | 4/1977 | Pfefferle . |

(List continued on next page.)

FOREIGN PATENT DOCUMENTS

| | | | |
|---|---|---|---|
| 59-024122 | 2/1984 | Japan | F23R 3/40 |
| 60-014938 | 1/1985 | Japan | B01J 23/42 |
| 60-200021 | 10/1985 | Japan | F23R 3/40 |
| 244339 | 12/1985 | Japan . | |
| 140646 | 6/1987 | Japan . | |
| 216642 | 9/1987 | Japan . | |
| 88041 | 4/1988 | Japan . | |
| 238311 | 10/1988 | Japan . | |
| 296842 | 12/1988 | Japan . | |
| 294411 | 12/1988 | Japan . | |
| 57002 | 3/1989 | Japan . | |
| 116305 | 5/1990 | Japan . | |

(List continued on next page.)

OTHER PUBLICATIONS

Attfield et al "Structural Correlations . . . " J. Solid State Chem. 80, 286–298 (1989).

Attfield, "Ab Initio Structure Determinations of the La Pd Oxides . . . " Acta Cryst, (1988) B44, 563–568.

Kakhan et al, "Synthesis and Properties of . . . LaO–PdO . . . " Russian J Inorg. Chem. 27(8), 1982 p. 1180.

Kato et al "Lanthanide B–Alumina Supports . . . " in Successful Design of Catalysts, Inui (ed) (1988).

McDaniel et al "Phase Relations Between PdO . . . " Journal of Research of the Nat. Bur. of Stand. 72A vol. Jan.–Feb. 1968.

Muller et al "Synthesis and Crystal Chemistry . . . " in Platinum Group Metals and Compounds, ACS 1970.

Cullis et al "Role of the Catalyst Support . . . Palladium" Trans. Far. Soc. 8, p. 1406 (1972).

*Primary Examiner*—Larry Jones

[57] ABSTRACT

A catalyst bed (30) for a combustor (18) for supporting the catalytic combustion of a gaseous air/fuel (e.g., methane or natural gas) combustion mixture contains an igniter catalyst member (1) upstream of a promoter catalyst member (2). The catalyst members each comprise carrier monoliths, the igniter catalyst member (1) having an igniter catalyst material deposited thereon and the promoter catalyst member (2) having a promoter catalyst material deposited thereon. The igniter catalyst material is distinguished from the promoter catalyst material in one or more of the following ways: the igniter catalyst material may have (a) a higher catalytic activity for combustion of the air/fuel mixture, (b) a lower catalyst deactivation temperature than the promoter catalyst material, and/or (c) the promoter catalyst regeneration temperature range brackets the upper limit of the regeneration temperature range of the igniter catalyst.

21 Claims, 3 Drawing Sheets

U.S. PATENT DOCUMENTS

| | | | |
|---|---|---|---|
| 4,021,185 | 5/1977 | Hindin et al. . | |
| 4,056,489 | 11/1977 | Hindin et al. . | |
| 4,065,917 | 1/1978 | Pfefferle . | |
| 4,089,654 | 5/1978 | Polinski et al. . | |
| 4,094,142 | 10/1978 | Pfefferle . | |
| 4,154,568 | 5/1979 | Kendall et al. . | |
| 4,170,573 | 10/1979 | Ernest et al. . | |
| 4,791,091 | 12/1988 | Bricker et al. . | |
| 4,793,797 | 12/1988 | kato . | |
| 4,843,056 | 6/1989 | Matsumoto et al. . | |
| 4,888,103 | 12/1989 | Herbst et al. . | |
| 4,893,465 | 1/1990 | Farrauto et al. | 60/39.02 |
| 4,906,176 | 3/1990 | Yamashita et al. . | |
| 5,000,929 | 3/1991 | Horiuchi et al. . | |
| 5,047,381 | 9/1991 | Beebe . | |
| 5,079,064 | 1/1992 | Forsythe . | |
| 5,102,639 | 4/1992 | Chou et al. | 423/263 |
| 5,169,300 | 12/1992 | Chou et al. . | |
| 5,228,847 | 7/1993 | Lywood et al. | 431/11 X |

FOREIGN PATENT DOCUMENTS

| | | | |
|---|---|---|---|
| 169003 | 6/1990 | Japan . | |
| 237643 | 9/1990 | Japan . | |
| 4335911 | 11/1992 | Japan | F23D 14/18 |
| 2114016 | 7/1983 | United Kingdom . | |
| 105861 | 5/1992 | WIPO . | |
| 9209365 | 6/1992 | WIPO . | |
| 9209848 | 6/1992 | WIPO . | |
| 9209849 | 6/1992 | WIPO . | |
| 9218243 | 10/1992 | WIPO | B01J 23/56 |

CATALYST CONFIGURATION FOR CATALYTIC COMBUSTION SYSTEMS

CROSS-REFERENCE TO RELATED APPLICATION

This application is a continuation-in-part of application Ser. No. 07/852,371, filed Mar. 12, 1992, now U.S. Pat. No. 5,216,875, which is a continuation-in-part of Ser. No. 07/776,907, filed Oct. 16, 1991, now U.S. Pat. No. 5,214,912, which is a continuation-in-part of Ser. No. 07/465,678, filed Jan. 16, 1990, now abandoned, which was a continuation-in-part of Ser. No. 07/234,660, filed Aug. 22, 1989, now U.S. Pat. No. 4,893,465.

BACKGROUND OF THE INVENTION

1. Field of the Invention

The present invention relates to an apparatus and process for the catalytically supported combustion of gaseous carbonaceous materials, including natural gas and methane. In a more specific aspect, this invention relates to an apparatus and process for catalytically supported combustion of natural gas or methane using a supported palladium oxide catalyst.

2. Description of Related Art

Catalytically supported combustion processes have been described in the prior art, e.g., see U.S. Pat. No. 3,928,961 to Pfefferle and U.S. Pat. Nos. 4,065,917 and 4,019,316. The use of natural gas or methane in catalytic combustion has been taught in the art, as has the use of a palladium catalyst to promote such combustion oxidation. See U.S. Pat. No. 3,056,646 to Cohn, wherein the use of palladium catalyst to promote methane oxidation is disclosed, as is an operable temperature range of 271° C. to 900° C. (see column 2, lines 19–25).

U.S. Pat. No. 4,154,568 to Kendall et al, dated May 15, 1979 discloses a catalyst bed design comprising a plurality of carrier monoliths in the flow stream of the air-fuel mixture, wherein the channel size in respective monoliths decreases progressively for monoliths at progressively downstream positions, to provide substantially complete combustion in the catalyst bed (see column 1, lines 47–59).

SUMMARY OF THE INVENTION

In accordance with the present invention there is provided a combustor for catalytically promoting thermal combustion of an inlet combustion gas mixture flowed sequentially through an igniter catalyst zone, a promoter catalyst zone, and then a downstream zone of the combustor, the downstream zone providing a homogeneous reaction zone. The combustor comprises the following components. An igniter catalyst member, which may be comprised of one, two or more discrete bodies of igniter carrier, is disposed in the igniter catalyst zone and comprises an igniter carrier having a plurality of gas flow channels extending therethrough and defined by channel walls on which an igniter catalyst composition is carried. A promoter catalyst member, which may be comprised of one, two or more discrete bodies of promoter carrier, is disposed in the promoter catalyst zone and comprises a promoter carrier having a plurality of gas flow channels extending therethrough and defined by channel walls on which a promoter catalyst composition is carried. The igniter catalyst member and the promoter catalyst member together comprise a combustor catalyst which is characterized by at least one, or two, or all three of the factors (a), (b) and (c), as follows: (a) the igniter catalyst member has a higher activity for combustion of the inlet combustion gas mixture than does the promoter catalyst member; (b) the igniter catalyst member has a lower catalyst deactivation temperature than does the promoter catalyst member; and (c) the promoter catalyst member has a catalyst regeneration temperature range which extends from a temperature higher than, to a temperature lower than, the upper limit of the regeneration temperature range of the igniter catalyst member.

In one aspect of the present invention, the igniter catalyst member and the promoter catalyst member may each comprise discrete bodies disposed in proximity to each other, or in abutting contact with each other.

A particular aspect of the present invention provides that the combustor catalyst may be characterized by at least (c) and the regeneration temperature of the promoter catalyst member may extend from a temperature at least about 10° C. higher, (e.g., about 10° to 400° C. higher) to a temperature at least about 20° C. lower, (e.g., about 20° to 700° C. lower) than the upper limit of the regeneration temperature range of the igniter catalyst member.

One aspect of the present invention provides that the igniter catalyst composition may comprise palladium oxide dispersed on a refractory metal oxide igniter support; the refractory metal oxide igniter support may be selected from the group consisting of one or more of unimpregnated alumina, alumina impregnated with a rare earth metal oxide, unimpregnated zirconia, zirconia impregnated with a rare earth metal oxide, silica, titania and a co-formed rare earth metal oxide-zirconia.

Still another aspect of the present invention provides that the promoter catalyst composition may be selected from the group consisting of one of (A) a first promoter catalyst composition comprising palladium oxide dispersed on a refractory metal oxide promoter support, (B) a second promoter catalyst comprising a combination of (i) the reaction product of palladium oxide and a metal oxide selected from the group consisting of one or more of samaria, lanthana and praseodymia, combined with (ii) a refractory metal oxide binder, and (C) a sequence of (A) and (B) with (A) disposed upstream of (B). The support material for the first promoter catalyst composition may comprise alumina impregnated with a rare earth oxide, and the binder of (ii) may be selected from the group consisting of silica, alumina, alumina stabilized with a rare earth oxide, titania, zirconia and mixtures thereof.

As used herein and in the claims, the terms "upstream" and "downstream" refer to the relative placement of elements sensed in the direction of flow of the combustion mixture through a catalyst apparatus according to the invention.

BRIEF DESCRIPTION OF THE DRAWINGS

2A, showing in cross section one of the gas flow channels of catalyst member 1.

DETAILED DESCRIPTION OF THE INVENTION AND SPECIFIC EMBODIMENTS THEREOF

Figure 1:
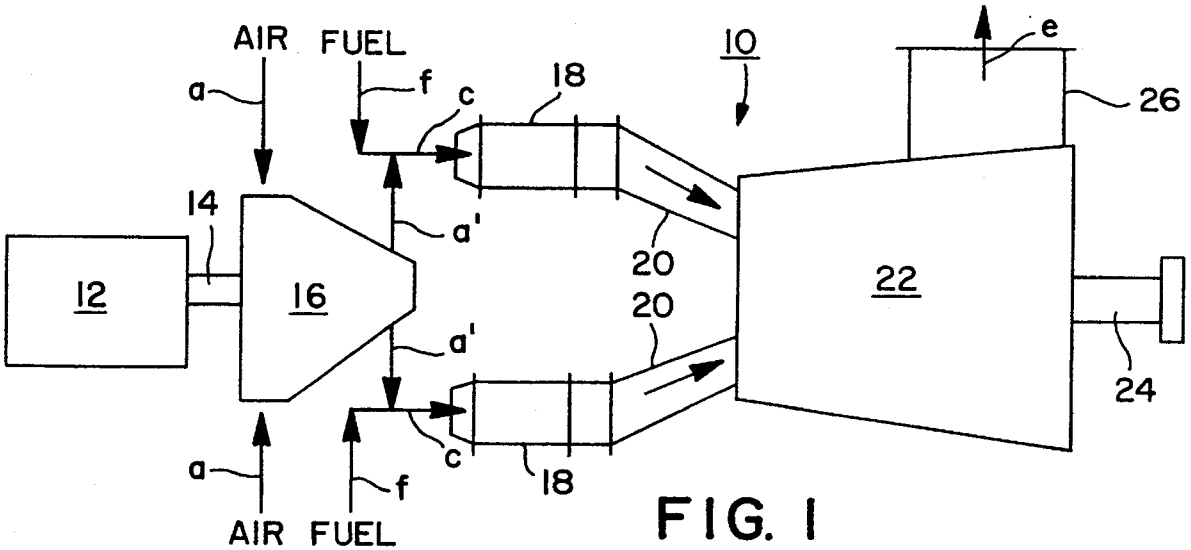
FIG. 1 is a schematic plan view of a gas turbine unit utilizing catalytic thermal combustors in accordance with one aspect of the present invention.

Burning of carbonaceous fuels is associated with formation of air pollutants, among the most troublesome of which are nitrogen oxides ($NO_x$). Nitrogen oxides form oxides involves catalytic post-treatment to reduce $NO_x$ to whenever air-supported combustion takes place at open-flame temperatures. One approach to eliminating nitrogen oxides involves catalytic post-treatment to reduce $NO_x$ to nitrogen. A more economical method is to operate the combustion of $NO_x$ during combustion. process catalytically, at a temperature lower than open-flame temperatures, so as to avoid or reduce formation of $NO_x$ during combustion.

It has long been realized that little or no $NO_x$ is formed in such a catalytic system. Typically, such catalytic combustion of natural gas or methane utilizes a preburner or thermal combustor which employs flame combustion to preheat combustion air to a temperature of 400° C. or higher. Once the catalyst is sufficiently hot to sustain catalysis, the preburner is shut down and all the fuel and air are directed to the catalyst. Such a catalytic combustor, if operated at temperatures below about 1300° C. to 1500° C., avoids or at least controls to acceptable levels the $NO_x$ formation which occurs at the higher temperatures which are characteristic of (non-catalytic) flame combustion. However, it has generally been regarded as commercially infeasible to conduct such catalytic combustion effectively at high space velocities. Reasons for this lack of commercial attractiveness include the difficulty of economically combusting methane, the principal component of natural gas, and the deactivation and instability of the catalyst compositions employed, especially in the high-temperature end of the catalyst bed where severe high temperatures may be reached. Palladium oxide catalysts are deactivated at temperatures of above about 800° C. Because of the susceptibility of the catalyst to such thermal deactivation, many catalytic combustor designs are limited with respect to the type and amount of fuel they can combust in order to avoid deleterious high temperatures.

The present invention provides a catalytic combustor design which achieves stable combustion of gaseous fuel/air combustion mixtures under controlled conditions to provide low levels of pollutants, such as carbon monoxide, unburned hydrocarbon, and nitrogen oxides in the exhaust gas, and which provides efficient steady state operation of the combustor. Generally, the invention relates to an apparatus and process for catalytically supported combustion of natural gas, methane or other fuels as mentioned below, by utilizing a combustor catalyst having at least two catalyst zones, an igniter catalyst zone and a promoter catalyst zone, with the igniter catalyst zone being disposed upstream of the promoter catalyst zone. Both zones comprise at least one catalyst member comprising a carrier coated with a catalyst material. Generally, the catalyst material comprises a platinum group metal, such as palladium oxide, dispersed on a refractory metal oxide support material.

The support materials may comprise high surface area alumina, either unimpregnated or impregnated to stabilize the alumina against thermal surface area degradation. Other support materials include unimpregnated zirconia, zirconia impregnated with, e.g., a rare earth metal oxide, a co-formed rare earth metal oxide-zirconia, e.g., ceria-zirconia, such as is described in International Patent Publication WO92105861 (PCT/US91/06940) of Engelhard Corporation, silica or titania.

The catalyst members and the catalyst compositions thereon are adapted to initiate catalytically-supported combustion at the surfaces thereof of an air/fuel mixture, such as air/natural gas, and to support, combustion of the air/fuel mixture at a point downstream of the catalyst members. By maintaining the homogeneous (flame) reaction zone downstream of the catalyst members, the catalyst compositions are not exposed to deactivating temperatures resulting in decomposition of the active species, e.g., PdO, and the production of nitrogen oxides is further limited.

Fuel combustion advances as the air/fuel mixture flows through the catalyst members of the combustor and a temperature gradient is therefore established whereby the promoter zone (the downstream segment of the catalyst) operates under and is subjected to higher temperatures than the igniter zone (the upstream segment of the catalyst). For this reason, the present invention provides that the igniter catalyst composition is differentiated from the promoter catalyst composition in at least one of several ways. Generally, according to the present invention, the igniter-promoter catalyst sequence is characterized as exhibiting decreasing catalytic activity, increasing thermal stability, or escalating regeneration temperature ranges. It will be appreciated, therefore, that no single catalyst material is inherently an igniter or promoter catalyst material; these designations derive from the comparison of one or more characteristics of a particular catalyst material to those of another.

According to one aspect of the present invention, the catalytic activity of the igniter catalyst composition for initiating combustion of the air/fuel mixture may be higher than that of the promoter catalyst composition. This differentiation is useful because the igniter catalyst composition must initiate the combustion of a gaseous air/fuel mixture at a point upstream of, and therefore at a lower temperature than, the promoter catalyst composition. The proper sequencing of any two given catalyst materials according to this aspect of the invention can be determined by contacting with the catalyst materials a test combustion mixture comprising a carbonaceous fuel representative of the fuel to be burned when the combustor is put to use. For example, a test sample of catalyst material may be disposed on the walls of a suitable honeycomb-type carrier, to provide a test catalyst member, and the test combustion mixture may be flowed through the test catalyst member. Then, the effluent may be evaluated for its fuel or combustion product content.

In one such test, the inlet temperature of the test combustion mixture can slowly be increased, and the temperatures at which particular levels of fuel conversion are achieved may be noted, lower temperatures signifying greater activity. Such a test, illustrated below in Example 3, indicates that the following catalyst materials are given in an order of decreasing catalytic activity: 8% PdO dispersed on an unimpregnated (i.e., unstabilized) alumina support; 8% PdO dispersed on a ceria-zirconia support; 4% PdO on a ceria-zirconia support or 8% PdO on 10% ceria-impregnated alumina support (the activity of these latter two being similar); 4% PdO on an unimpregnated alumina support; and a mixture of 7% $La_4PdO_7$ with 93% alumina as a binder. Therefore, to choose an igniter/promoter catalyst sequence from the foregoing list, any material except the last may be used as the igniter catalyst material and any subsequent material may be used as the promoter material. The activity sequence of other catalyst materials can be determined from activity data provided in the discussion and TABLES that follow or by testing the materials as described herein. It will be appreciated that the invention is not limited to catalyst beds having two catalyst members; additional catalyst members may be employed and are preferably disposed in the catalyst bed in accordance with at least one of the sequencing criteria described herein for the igniter and promoter catalyst members. For example, the promoter catalyst zone may contain two catalyst members, each of which comprise a catalyst material less active than the igniter catalyst material.

It should be noted that some variation in activity is known to occur among catalyst materials having the same formulation but having been prepared under different procedures. However, given the teachings of this disclosure, one skilled in the art can determine the relative activity of a given catalyst material without undue experimentation. In addition, the foregoing list of catalyst materials should not be interpreted to indicate that the catalyst materials according to the present invention must comprise palladium; it will be appreciated by those skilled in the art that catalyst materials may comprise one or more platinum group metals, e.g., one or more of platinum, palladium, rhodium, rutheinium, osmium and iridium. The choice of catalyst material in a given case may in part be determined by the type of fuel to be burned, the expected operating temperature and by other operating conditions or constraints. As suggested above, natural gas is a common fuel, but the present invention finds utility in processes for combusting other fuels as well, e.g., number 2 fuel oil, jet fuel, normally liquid hydrocarbon fuels, alcohols, e.g., methanol, oxygenated hydrocarbons, and even hydrogen, which may be reacted with carbon monoxide.

Alternatively, it may be advantageous for the promoter catalyst composition to be more stable than the igniter catalyst composition with respect to exposure to high temperatures because the promoter catalyst composition is subject to higher operating temperatures. Thermogravimetric analysis (TGA) may be used to determine the temperature at which the catalyst material decomposes to an inactive species, as taught, for example, in U.S. Pat. No. 4,893,465 to Farrauto et al. This Patent, the disclosure of which is incorporated herein by reference, describes experimental data showing that a loss of methane oxidation capability is associated with the decomposition of palladium oxide to palladium metal. Generally, TGA involves heating the sample in air at a set rate of temperature increase and noting when the sample weight begins to change. In the case of palladium oxide catalysts, the onset of decomposition is indicated by weight loss as the palladium oxide decomposes to elemental palladium, releasing oxygen. A TGA study of the catalyst materials discussed above with regard to activity suggests the following different sequence of catalyst materials, in order of increasing thermal stability: 4% PdO on $Al_2O_3$; 8% PdO on $Al_2O_3$; 4% PdO on ceria-zirconia; 8% PdO on ceria-impregnated alumina; 8% PdO on ceria-zirconia; and $La_4PdO_7$ (tested apart from the alumina binder). Decomposition temperatures of these and other materials are given below. While the catalytic activity of the more temperature-resistant catalysts is sometimes lower than that of other catalyst materials, this is not considered to be a detriment in the promoter catalyst zone because the higher temperatures that prevail in this zone can compensate for diminished catalytic activity.

Further still, it is known that some catalyst materials, particularly palladium oxide compounds, can regenerate themselves, i.e., regain catalytic activity after being thermally deactivated by decomposition of the palladium oxide to palladium metal. Such regeneration can take place spontaneously upon exposure to air within a regeneration temperature range characteristic of the specific catalyst employed, the maximum regeneration temperature being lower than the deactivation temperature. If the catalyst is overheated, as may occur due to upset conditions during operation, it may be regenerated and restored to activity by heat treatment in the regeneration temperature range. Given the temperature gradient that typically exists in combustor beds, it may be advantageous for the promoter catalyst member to have a maximum regeneration temperature which exceeds even the upper limit of the regeneration temperature range of the igniter catalyst. In addition, since the downstream portion of the igniter catalyst member and the upstream promoter catalyst member are in close proximity, if not abutting one another, it is preferred that the regeneration temperature range of the promoter catalyst extend into the regeneration temperature range of the igniter catalyst material, so that they may regenerate simultaneously. That is, the regeneration temperature range of the promoter catalyst may preferably extend from a temperature higher than, to a temperature lower than, the upper limit of the regeneration temperature range of the igniter catalyst.

Regeneration temperature ranges can be determined using the TGA apparatus, by lowering the temperature of decomposed material and noting when the material begins to exhibit an increase in weight gain signifying the recombination of oxygen with palladium. The foregoing catalyst materials may be ordered according to the present invention in sequence of increasing upper limits for regeneration as follows: 4% PdO on unimpregnated alumina; 8% PdO on unimpregnated alumina; 4% PdO on ceria-zirconia; 8% PdO on ceria-zirconia; 8% PdO on ceria-impregnated alumina; and $La_4PdO_7$ (without binder).

It will be apparent from the foregoing that a sequence of catalyst materials according to the present invention may satisfy one or more of the activity, thermal stability, and regeneration criteria without satisfying another.

As indicated above, U.S. Pat. No. 4,893,465, discloses a catalyst comprising palladium oxide dispersed on an alumina support and teaches that such a catalyst calcining gamma alumina at 950° C. for 2 hours and then screening the alumina to particles sizes of between 50 and 150 microns. This gamma alumina is used as a catalyst carrier. The use of gamma alumina as a catalyst carrier, as those skilled in the art will readily appreciate, is simply a matter of choice. Other suitable carriers include, for example, modified alumina (i.e., aluminas which contain surface area stabilizers such as silica, barium oxide, lanthanium oxide and cerium oxide), zeolites, and the other materials recited above, as well as mixtures of any of the foregoing. The carrier, e.g., the alumina, is impregnated with a $Pd(NO_3)_2.6H_2O$ solution by the incipient wetness method to give approximately 4 weight percent Pd on the finished catalyst. The Pd is then fixed on the carrier by a conventional reduction with an aqueous hydrazine solution. The reduced catalyst is dried at 120° C. overnight and calcined at 500° C. for 2 hours. This patent also teaches that such a catalyst becomes deactivated at about 800° C. at one atmosphere in air. It also teaches that the catalyst can be regenerated by lowering the temperature to a range of from about 530° C. to 650° C. at atmospheric pressure until the described catalytic activity is restored. The deactivation and regeneration of palladium oxide catalysts comprising other support materials is addressed in the U.S. patent application Ser. No. 07/776,907 filed Oct. 16, 1991 and U.S. patent application Ser. No. 07/852,371 filed Mar. 13, 1992, both of which are assigned to the assignee of the present application. As discussed in these patent applications, and in particular in application Ser. No. 07/776,907, the range of temperatures within which regeneration occurs differs among catalysts having different support materials on which the palladium oxide is dispersed as reflected in the following TABLE I. It is to be noted that all decomposition and regeneration temperatures for catalyst species set forth in the TABLES and elsewhere herein are based on decomposition or regeneration in air at atmospheric pressure. It should further be noted that all catalyst species regeneration and decomposition temperatures reported herein were measured on a Dupont 951 Thermal Analyzer using heating and cooling rates of 20° C. per minute with an air flow of 40 cubic centimeters per minute measured at standard conditions of temperature and pressure. Those skilled in the art will appreciate that the use of different equipment or different measurement conditions could result in somewhat different measured values for such regeneration and decomposition temperatures and that such different temperatures may nonetheless be equivalent to those described herein once allowance is made for differences in equipment and/or measurement conditions.

TABLE I

Decomposition and Reformation Temperatures For Palladium Oxide/Palladium on Various Metal Oxide Supports

| Catalyst[a] | Degrees Centigrade | | |
|---|---|---|---|
| | $T_D$[1] | $T_R$[2] | $T_D$–$T_R$[3] |
| 4% $PdO/Al_2O_3$ | 810 | 600 | 210 |
| 4% $PdO/Ta_2O_5$ | 810 | 650 | 160 |
| 4% $PdO/TiO_2$ | 814 | 735 | 80 |
| 4% $PdO/CeO_2$ | 775 | 730 | 44 |
| 4% $PdO/ZrO_2$ | 682 | 470 | 212 |

[1]T = Decomposition onset temperature of PdO to Pd
[2]T = Reformation onset temperature of Pd to PdO
[3]$T_D$–$T_R$ represents the hysteresis discussed in the patent application.
[a]The 4% figure in the first column of the Table is the weight percent of palladium as the elemental metal in the catalyst.

Thus, if the igniter catalyst composition comprises palladium oxide dispersed on ceria and has a deactivation onset temperature of about 775° C., the promoter catalyst composition may be one having a higher deactivation onset temperature, e.g., palladium oxide dispersed on titania, alumina or tantalum oxide, all of which have decomposition temperatures, i.e., deactivation onset temperatures, higher than 775° C.

Arranging the igniter and promoter catalysts according to regeneration temperature will facilitate the in situ regeneration of the catalyst bed because the higher temperatures that exist in the downstream portion of the promoter catalyst zone might not be low enough to permit the onset of catalyst regeneration of the igniter catalyst, but may yet be within the regeneration temperature range of the promoter catalyst. For example, when the igniter catalyst composition comprises palladium oxide dispersed on alumina and it is desired to regenerate the catalysts in situ without shutting down the combustor, it may be useful to employ a promoter catalyst composition comprising palladium oxide dispersed on ceria. This arrangement is suggested by the data in TABLE I, which shows that a $PdO/CeO_2$ catalyst begins to regenerate at 730° C., whereas a $PdO/Al_2O_3$ catalyst must be cooled to about 600° C. before it will begin to regenerate. Likewise, the characteristics of the binary oxide catalyst materials described below and set forth in TABLES III and IV, would dictate the placement of these compositions in the promoter catalyst zone, particularly in relation to igniter catalysts comprising standard palladium oxide catalyst compositions.

Catalyst compositions comprising palladium oxide disposed on modified alumina supports can have different activities, deactivation and regeneration temperatures than those comprising an unmodified alumina support, as disclosed in aforesaid application number 07/852,371, and as shown in the following Table II, which appears as Table II in the aforesaid application 07/852,371.

TABLE II

| REO[1] (Moles) | Pd[2] (Moles) | Degrees Centigrade | | | |
|---|---|---|---|---|---|
| | | $T_A$[3] | $T_{D80}$[4] | $T_R$[5] | $T_D$–$T_R$[6] |
| La | | | | | |
| 0 | .004 | 334 | 889 | 638 | 251 |
| .002 | .004 | 368 | 912 | 598 | 314 |
| .004 | .004 | 354 | 900 | 587 | 313 |
| .008 | .004 | 378 | 916 | 735 | 181 |
| 0 | .008 | 324 | 921 | 635 | 286 |
| .002 | .008 | 328 | 916 | 621 | 295 |
| .004 | .008 | 324 | 917 | 610 | 307 |
| .008 | .008 | 352 | 920 | 730 | 190 |
| Ce | | | | | |
| .002 | .004 | 372 | 900 | 741 | 159 |
| .004 | .004 | 368 | 931 | 740 | 191 |
| .008 | .004 | 386 | 919 | 740 | 179 |
| .002 | .008 | 334 | 913 | 706 | 207 |
| .004 | .008 | 318 | 880 | 724 | 174 |
| .008 | .008 | 346 | 889 | 743 | 146 |
| Pr | | | | | |
| .002 | .004 | 364 | 927 | 600 | 327 |
| .004 | .004 | 360 | 927 | 608 | 319 |
| .008 | .004 | 366 | 954 | 589 | 365 |
| .002 | .008 | 330 | 920 | 700 | 220 |
| .004 | .008 | 330 | 920 | 719 | 201 |
| .008 | .008 | 354 | 919 | 710 | 209 |

[1]"REO" is the rare earth metal content of the samples in moles of the metal per ten grams of fresh alumina.
[2]"Pd" is the palladium metal content of the sample in moles of Pd per ten grams of fresh alumina.
[3]$T_A$ = Activity Temperature, the temperature (in degrees Centigrade) at which combustion of 30% (vol.) of the $CH_4$ present in 1% (vol.) $CH_4$ in air mixture takes place at a 1.5 liters per minute flow rate through a sample of the catalyst weighing 0.06 grams.
[4]$T_{D80}$ = Decomposition Onset Temperature, the temperature (in degrees Centigrade) at which 80% of the weight loss attributed to PdO decomposition to Pd is attained.
[5]$T_R$ = Regeneration Onset Temperature, the temperature (in degrees Centigrade) at which regeneration of the catalyst by oxidation of Pd to PdO commences.
[6]$T_D$–$T_R$ represents the hysteresis discussed above (sic).

The data of TABLE II show that although the inclusion of the lanthanide (rare earth) metal oxides in the alumina generally decreased the activity of the catalyst as indicated by the activity temperature with increasing addition of rare earth oxide, $T_{D80}$, the temperature at which 80% of the weight loss attributed to decomposition of the palladium oxide catalyst is attained, was increased by the presence of the rare earth oxide modifier. The catalyst attained by utilizing a lanthanide metal-modified alumina as the metal oxide support is more resistant to high temperatures and therefore would find use in the higher temperature zones of a catalytic combustion catalyst where its somewhat reduced activity would be more than offset by the increased temperature.

It will be noted that different definitions of Decompostion

Onset Temperature, $T_D$, as defined in the footnote to TABLE I, and $T_{D80}$ as defined in footnote (4) of TABLE II are employed for, respectively, the unmodified (single compound) and modified (more than a single compound) metal oxide supports. This is because whereas the unmodified metal oxide supports such as those listed in TABLE I above exhibit a sharp and definite Decomposition Onset Temperature, the modified metal oxide supports of the type illustrated in TABLE II exhibit decomposition over a broad temperature range, for example, palladium oxide on cerium-modified alumina supports exhibit decomposition ranges of from about 80 to 131 degrees Centigrade, depending on the palladium oxide loading and the atomic ratio of Ce to Pd. Accordingly, for modified metal oxide supports, the points at which 80% by weight of the total decomposition weight loss occurs was arbitrarily selected as the Decomposition Onset temperature.

A catalyst composition may comprise the reaction product of palladium oxide with one or more of samaria, lanthana, neodymia and praseodymia to form binary oxides. The binary oxides of palladium with lanthanum, neodymium and samarium are discussed in commonly assigned, co-pending U.S. patent application Ser. No. 07/684,409 filed Apr. 12, 1991, the disclosure of which is incorporated by reference herein, and are characterized therein with respect to activity, decomposition and regeneration as shown in TABLE III, below, which is a compilation of Table I and an unnumbered Table following Table I in application Ser. No. 07/684,409.

TABLE III

| Sample No. | Catalyst | 20% Conversion Temperature, °C.[1] | $T_D$ °C. |
|---|---|---|---|
| 1 | $2La_2O_3.PdO$ | 463 | 1300° C. |
| 2 | $2Nd_2O_3.PdO$ | 512 | 1230° C. |
| 3 | $2Sm_2O_3.PdO$ | 622 | — |
| 4 (Comparative) | PdO | 389 | |

[1]Temperature at which there occurs conversion of 20% of the inlet methane in a 1% methane-in-air mixture flowing through the catalyst at 20 liters per minute at a space velocity of 1,350,000/hour.

The solid state reaction products of palladium oxide with, respectively, praseodymia, neodymia and lanthana are disclosed as combustion catalyst materials in commonly assigned, co-pending U.S. patent application Ser. No. 07/684,631 filed Apr. 12, 1991, now U.S. Pat. No. 5,102,639. The $Pr_4PdO_7$ material is described as having catalytic activity and a deactivation onset temperature comparable to the other binary oxides, but has a high regeneration onset temperature of about 1038° C., as shown in the following TABLE IV, which also appears in U.S. Pat. No. 5,102,639. The subject matter of U.S. Pat. No. 5,102,639 is incorporated by reference herein.

TABLE IV

Thermal Properties of $Pr_4PdO_7$, $Nd_4PdO_7$ and $La_4PdO_7$

| Primary Active Species in the Reaction Product | Td °C. | Tr °C. | Approximate Regeneration Weight Gain |
|---|---|---|---|
| $Pr_4PdO_7$ | 1220–1310 | 1038–1000 | 90% |
| $Nd_4PdO_7$ | 1230–1290 | 767–730 | 5% |
| $La_4PdO_7$ | 1300–1350 | 767–730 | 5% |

Td = decomposition temperature, i.e., temperature at which the binary oxide decomposes to the metals.
Tr = regeneration temperature, i.e., the temperature at which palladium metal re-oxidizes to palladium oxide or the binary oxide.

As set forth in U.S. Pat. No. 5,102,639, $Pr_4PdO_7$, has vastly superior regenerative properties as compared to the corresponding La and Nd binary oxides. In fact, without wishing to be bound thereof, it is believed that $Nd_4PdO_7$ and $La_4PdO_7$, upon being over-temperatured degrade to produce palladium metal and regenerate to PdO rather than to the binary oxide. In any case, the binary oxide catalytic material is typically mixed with a binder material to prepare a slurry for coating onto a carrier monolith. Such binders include for example, silica, alumina, titania and zirconia. When alumina is used, it is preferably impregnated with a rare earth oxide to inhibit interaction between the catalyst material and the binder.

The carriers on which the igniter catalyst composition and the promoter catalyst composition are carried are typically monoliths having a plurality of fine gas flow passages extending therethrough, from an inlet to an outlet face of the body, to provide a somewhat honeycomb-type structure. The gas flow passages (sometimes referred to as "cells") in the honeycomb structure are substantially parallel and defined by thin walls, and may be of any desired cross section such as square, rectangular, triangular or hexagonal shape. The number of channels per square inch of face surface, i.e., per cross-sectional square inch (cpsi), may vary, depending upon the particular application for which the catalyst bed is to be used. Such honeycomb-type carriers are commerically available having anywhere from about 9 to 600 or more cpsi. The substrate or carrier monolith desirably is porous and may (but need not) be relatively catalytically inert to the combustion reaction as compared to the active layers used in the invention.

The carrier monoliths used in the combustor of the present invention should be refractory in nature, i.e., able to withstand thermal shock caused by the sudden increase or decrease in temperature experienced at start-up and shutdown of the combustor. The monoliths should also have good thermal strength so that they do not develop structural flaws at the operating temperatures of the combustor, i.e., temperatures as high as 1,500° C. Conventional cordierite monoliths such as those used to support 3-way catalysts for treating the exhaust gases of automotive internal combustion engines are generally not considered to be suitable in combustors of the present invention because they can melt or otherwise fail at combustor operating temperatures. More suitable substrates comprise a combination of cordierite and other oxide materials, e.g., a mixture of alumina, mullite and cordierite. Such substrates have physical properties more suited to combustor operation than conventional ceramic substrates, i.e., better thermal strength and thermal shock resistance, and are commercially available, e.g., from the Dupont Company under the designation PRD-66. An elemental analysis of this material provided by the Dupont Company describes the material containing 70.4 weight percent $Al_2O_3$, 24.9 weight percent $SiO_2$ and 4.2 weight percent MgO. However, another analysis resulted in proportions of about 62.7–63.4 weight percent $Al_2O_3$, 31.2–31.3 weight percent $SiO_2$ and 5.4–5.7 weight percent MgO. A more detailed description of this material may be found in U.S. Pat. No. 5,079,064, the disclosure of which is hereby incorporated herein by reference. For purposes of the present invention, such monoliths are referred to herein as "Type I" monolith.

The igniter and promoter catalyst members of the present invention may be prepared according to known preparation techniques, viz., a catalytic material containing the catalyst is applied to a carrier by dipping the carrier into an aqueous slurry of fine particles of the catalytic material, in order to coat the gas flow passage walls. Excess slurry is removed, e.g., by blowing it out of the gas flow passages with compressed air, and the coated structure is dried and then calcined in air at temperatures of about 500° C. for about 2 hours to provide an adherent "washcoat" of catalytic material on the walls defining the gas flow passages.

The present invention serves, in another aspect, to alleviate catalyst failures by providing a thermal buffer or separator body disposed in a separator zone situated between the promoter zone where the promoter catalyst member is disposed and the downstream zone where high temperature homogeneous combustion occurs. The separator body is described more fully in commonly assigned, co-pending U.S. patent application Ser. No. 08/024,707, filed Mar. 1, 1993, the disclosure of which is hereby incorporated herein by reference. Briefly stated, the separator body preferably comprises a monolith similar in configuration to the carriers on which catalyst materials are deposited to form the catalyst members as described herein, i.e., it may take the form of a honeycomb monolith having a plurality of parallel gas flow passages extending therethrough. The separator body is made of a material that can withstand exposure to the high temperatures produced by the homogeneous combustion that occurs in a downstream zone of the combustor. Usually, a catalyst material will not be deposited on the gas flow channels of the separator body although a coating of a refractory metal oxide such as alumina may be coated thereon.

Due to its placement between the promoter zone and the downstream zone where homogeneous combustion occurs, the separator body acts as a thermal shield or insulator to partially insulate the catalyst members from the high temperatures engendered by the homogeneous reaction. The separator body may, but preferably does not, comprise catalytically active materials, since such materials tend to be vulnerable to deactivation when exposed to the temperatures that the separator body sometimes experiences. Thus, even when the temperature in the downstream zone is excessive, the likelihood of thermal deactivation of the catalyst members and the associated loss in combustion efficiency is diminished. To achieve this effect, the separator body is disposed in close proximity to the promoter catalyst member, i.e., it is either disposed in abutting relation to the catalyst member or is sufficiently close so that the channeled flow of gases through the promoter catalyst member is substantially preserved as channeled flow through the separator body.

While Type I monoliths are superior to conventional cordierite monoliths for the reasons discussed above, even Type I monoliths sometimes lose their thermal strength under high operating temperature conditions, especially when disposed in downstream positions in the combustor. Such weakness is believed to be the result of an attack upon the Type I monolith by high temperature steam produced in the combustion reaction, which leads to deleterious interaction between the carrier and the active layer thereon. Accordingly, separator bodies used in connection with the present invention comprise a downstream carrier which is stabilized against such degradation. One such support is available from the Minnesota Mining and Manufacturing Co. (3M) under the trade designation "Siconex". These monolith substrates are described by the manufacturer as being formed from a series of layers of woven alumina-boria-silica inorganic fibers. The thus formed monolith is then coated with silicon carbide in a vapor deposition process which is believed to result, after calcination, in a silica layer on the surface of the silicon carbide matrix within which the inorganic fibers are disposed. The silicon carbide matrix monoliths have been found to provide superior long-term thermal strength in relation to the Type I monoliths, and are referred to herein as Type II monoliths. The 3M Company provided an assay of its Type II monolith, which describes the monolith as comprising about 70% silicon carbide and about 30% NEXTEL™ 312 ceramic fibers. The NEXTEL™ 312 ceramic fibers are described as comprising an alumina-boria-silica material comprising 62 weight percent $Al_2O_3$, 14 weight percent $B_2O_3$ and 24 weight percent $SiO_2$.

In a preferred embodiment of the present invention, the igniter catalyst composition comprises palladium oxide dispersed on support material comprising unimpregnated high surface area alumina and the promoter catalyst composition preferably comprises palladium oxide dispersed on high surface area alumina which is stabilized against thermal degradation in a conventional manner known in the art, e.g., by the impregnation into the alumina of a stabilizing oxide, preferably a rare earth metal oxide in particular, ceria. Preferably, the igniter catalyst member and the promoter catalyst member comprise Type I monoliths. Further, it is preferred to dispose a separator body disposed downstream of the catalyst members to thermally shield the catalyst members from the heat produced in the downstream zone, and the separator body preferably comprises a Type II monolith as described below.

Preferably, the igniter catalyst member and the promoter catalyst member and, if present, the separator body, are discrete bodies within the combustor. In other words, the igniter catalyst member will preferably comprise the igniter catalyst composition disposed on the igniter carrier and the promoter catalyst member will likewise comprise the promoter catalyst composition on a separate promoter carrier. Then, the igniter catalyst member and the promoter catalyst member may be disposed within the combustor in adjacent, preferably in abutting, upstream/downstream relation to one another. The catalyst members, thus disposed in proximity to each other, are preferably disposed with their respective gas flow channels in mutual alignment. Thus, the flow of combustion gases through the igniter catalyst member will be channeled into the promoter catalyst member. If the two catalyst members are not abutting, they should be in close proximity, whereby the channeled gas flow is maintained between them. Alternatively, the igniter catalyst member and the promoter catalyst member may be formed on a single, integral monolith by applying a coating of the igniter catalyst composition on one end of the monolith and a coating of the promoter catalyst composition on the other end of the monolith. The separator body, which also comprises a refractory body having a plurality of gas flow channels extending therethrough, may likewise be part of a single monolith with a promoter catalyst member, with catalyst material being deposited on only one end of the monolith to provide the catalyst member, the other end providing the separator body. Optionally, the separator body monolith may have a coating thereon of a refractory inorganic oxide such as alumina.

Referring now to FIG. 1, there is shown in schematic plan view a gas turbine 10 comprising a starter engine 12 connected by an engine shaft 14 to an air compressor 16, which is provided with inlet air, via air inlet lines indicated by arrows a, which is compressed by compressor 16 and discharged via lines a into combustion gas inlet lines c which are also supplied with a pressurized gaseous fuel, such as natural gas or methane, via gas inlet lines indicated by arrows f. The air and fuel combine to form a combustion mixture which is introduced via lines c into a plurality of catalytic thermal combustors 18, two of which are illustrated in FIG. 1 although it will be appreciated that any suitable number may be employed. For example, eight such combustors 18 may be utilized with their outlets disposed equiradially about the inlet to the turbine. Each catalytic thermal combustor 18 is provided with an associated outlet duct 20 connected in gas flow communication with a turbine 22 which may comprise a multi-staged turbine as well known to those skilled in the art. Turbine 22 is drivingly connected to a load coupling shaft 24 to connect the turbine output to a suitable device, for example, an electric generator. The expended combustion products are exhausted as shown by arrow e via exhaust stack 26 for discharge to the atmosphere or for further use or processing.

Figure 2:
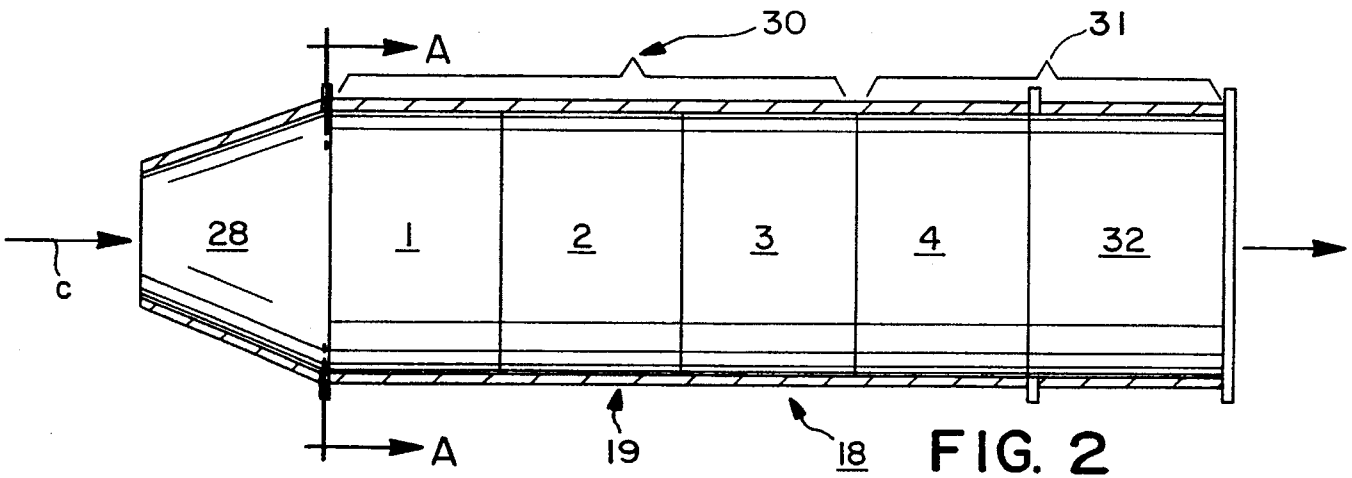
FIG. 2 is a schematic longitudinal cross-sectional view of one of the catalytic thermal combustors of FIG. 1 showing four cylindrical catalyst members arranged in sequential, abutting relation therein.

FIG. 2 shows a schematic cross-sectional view of a typical catalytic thermal combustor 18 comprising a cannister 19 having an inlet section 28, a catalyst bed or section 30 containing catalyst members 1, 2, and 3, and a downstream zone 31 including a separator body 4 and a homogeneous flame section 32. The three catalyst members 1, 2, and 3, and separator body 4 are arranged in sequential, abutting contact. That is, catalyst members 1 and 2 are positioned in face-to-face abutting contact, as are catalyst members 2 and 3. Catalyst member 3 and separator body 4 are also in abutting contact. In other embodiments, other arrangements may be used. For example, 1 and 2 may comprise catalyst members and 3 and 4 may comprise separator bodies. One or more of the catalyst members, e.g., catalyst member 1, comprises an igniter catalyst as described below and one or more catalyst members, e.g., catalyst member 2, located downstream of the igniter catalyst member comprises a promoter catalyst as described below.

Generally, the catalyst members, e.g., 1, 2, and 3, and separator body 4 comprise a refractory substrate material formed into what is sometimes referred to as a monolithic or honeycomb substrate or carrier. The carrier is a substantially cylindrical body (see FIG. 2A) having opposite end faces between which extend a plurality of generally parallel, fine gas flow passages. FIG. 2A shows a typical catalyst member end face la of catalyst member 1, schematically showing a plurality of fine, parallel gas flow passages extending longitudinally through catalyst member 1 to permit gas flow through catalyst member 1. This construction is typical of all the catalyst members 1 through 3 inclusively. The gas flow passages are defined by walls on which are disposed a coating (often referred to as a "washcoat") of an active material suitable to catalyze the oxidation of a gaseous fuel such as natural gas or methane. FIG. 3 shows a similar configuration, except that segments 3 and 4, instead of being in mutual abutting relation, are in proximal relation to one another.

Figure 2B:
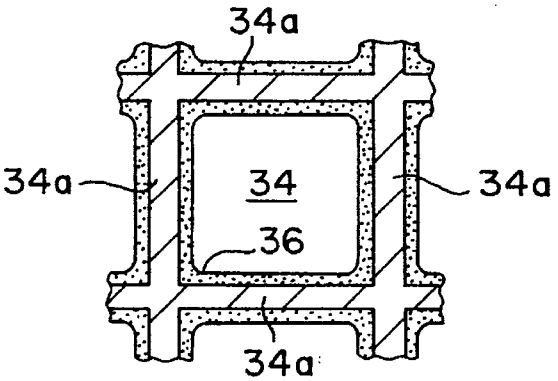
FIG. 2B is a view, greatly enlarged with respect to FIG.
Figure 2A:
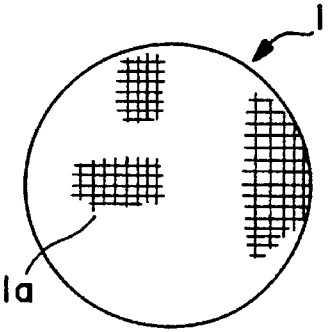
FIG. 2A is a view taken along line A—A of FIG. 2 showing a cross section of catalyst member 1 of FIG. 2.
Figure 3A:
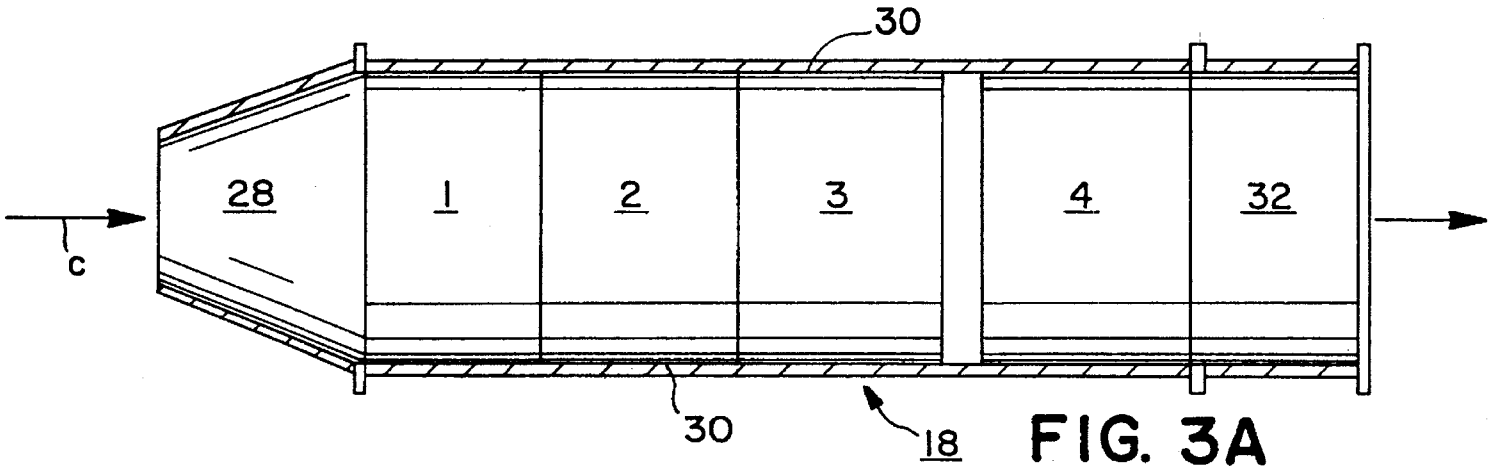
FIG. 3 is a view similar to that of FIG. 2 of a catalyst bed according to the present invention, including catalyst members in proximal spaced relation to one another.
Figure 3:
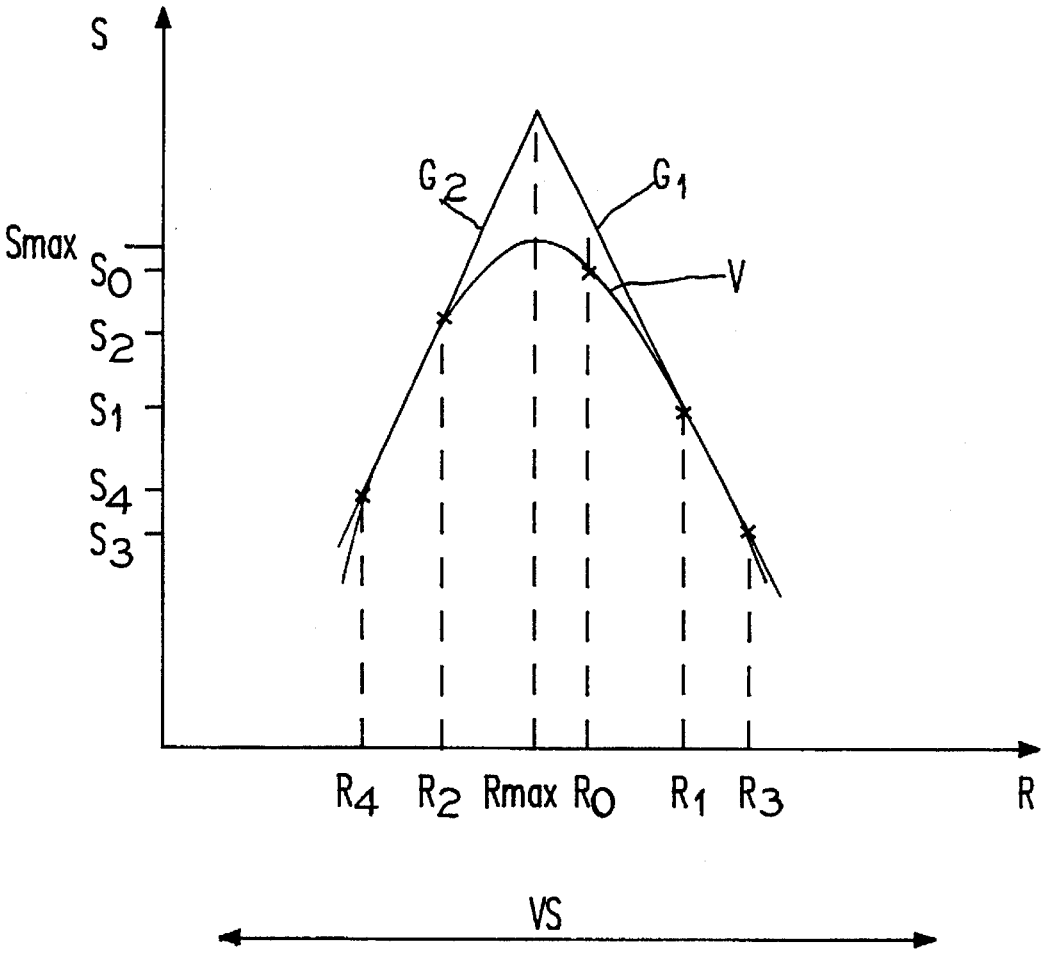

FIG. 2B shows an enlarged view corresponding to FIG. 2A in which a typical gas flow passage 34 is shown in cross-sectional view as being defined by four gas flow passage walls **34*a* on which is coated a catalytic material washcoat 36. The cross-sectional configuration of gas flow passage 34 illustrated in FIG. 2B** is rectangular but it will be appreciated that any suitable cross-sectional configuration may be employed such as square, polygonal, e.g., triangular, or circular. Further, the gas flow passages may have a configuration attained by alternating layers of flat and wave-form plates made of a suitable refractory material, as is well known to those skilled in the art.

EXAMPLE 1

To illustrate the effectiveness of $2La_2O_3.PdO$ for methane combustion, its performance was compared to a blank alumina washcoated honeycomb. Two catalyst bodies measuring 1 inch in diameter by 8 inches in length were prepared. The first 6 inches of each body was the same and comprised 1.5 g/in$^3$ PdO on alumina catalyst, coated onto a 64 cell per square inch alumina-silica-magnesia fiber honeycomb type support. The last 2 inches of a comparative sample was provided with a plain alumina washcoat, while the last two inches of an exemplary catalyst composition was provided with about 1.5 g/in$^3$ of a washcoat containing about 7 weight percent of the catalytic species $2La_2O_3.PdO$, balance (93 weight percent) alumina as a binder. The $La_4PdO_7$ was prepared by a method which comprises mixing an oxide of lanthanum with palladium oxide in selected weight ratios. The mixture is mechanically ground to a size range of about 50 to 100 micron diameter particles. The grinding is followed by calcination in air, for example, to provide a reaction mixture containing the binary oxide of palladium and lanthanum. Preferably, the lanthana and palladium oxide starting materials are mixed in stoichiometric proportions to produce the desired compound. Thus, the molar ratio of the lanthana to PdO in the reaction mixture may be 2:1, 1:1 or 1:2. Although it is not necessary to use the starting materials in the molar ratios of the desired binary oxide product, the use of such stoichiometric proportions has been found to be advantageous as described in aforesaid U.S. patent application Ser. No. 07/684,409.

The conversion of a combustion mixture comprising 4 volume percent methane in air was measured in a pilot reactor under three atmospheres pressure and 50 ft per second linear velocity of gas flow measured at inlet temperature and pressure. The comparative reactor containing the alumina blank showed a temperature increase of 200° C. across the reactor with an inlet gas temperature of 475° C. The exemplary reactor containing $2La_2O_3.PdO$ produced a temperature increase of 350° C. across the reactor under the same inlet gas conditions. The 150° C. greater increase in temperature across the exemplary reactor as compared to the comparative reactor is due to improved combustion induced by the $2La_2O_3.PdO$ catalyst. The exemplary catalyst, comprising only 25% of the length of the bed, induced a 75% improvement in overall efficiency of combustion as compared to a reactor in which 25% of the bed was comprised of a blank alumina catalyst. The exemplary catalyst also supported combustion of methane at close to 100% efficiency with an effluent containing less than 5 ppm unburned hydrocarbons and less than 2 ppm nitrogen oxides, while operating under catalytically-supported thermal combustion conditions of the type described below with reference to Pfefferle U.S. Pat. No. 3,928,961. The relatively modest temperature increment across the exemplary reactor and the exceedingly low level of hydrocarbons in the effluent clearly indicates that desired catalytically supported thermal combustion was attained, i.e., hydrocarbons were combusted downstream of the catalyst.

EXAMPLE 2

A. A catalytic combustion system was prepared as follows with two sections of catalyst, a first or upstream section positioned to be first contacted by the flowing gaseous combustion mixture stream, and a second or downstream section being last contacted by the flowing gaseous stream.

B. The first section was a catalyst body provided by a cordierite honeycomb having 400 cells per square inch of end face and being 1 inch (2.54 cm) in diameter, and 4 inches (10.2 cm) long and coated with 1.1 g/in$^3$ of alumina washcoat containing 8% PdO by weight of the dried, calcined washcoat.

C. The second section was a catalyst body provided by a honeycomb made of silica-alumina-magnesia fibers and of the same overall dimensions as used for the first section, but with 64 cells per square inch, coated with a washcoat of alumina mixed with $2La_2O_3.PdO$ particles and having a content of 1% by weight PdO equivalent contained in the binary oxide.

D. The combustion of methane was measured under the following conditions. A gaseous stream containing about 4% by volume methane in air was flowed at a velocity of 50 feet per second and at three atmospheres pressure in sequence through the first and second catalyst bodies. At an inlet temperature of 480° C., combustion of methane was complete, unburned hydrocarbons and oxides of nitrogen emissions were below 2 parts per million ("ppm").

The results of Examples 1 and 2 show that a catalyst composition in accordance with the invention may be utilized as a downstream promoter catalyst in combination with an upstream igniter catalyst comprised of a more active catalyst such as PdO. It is seen that the upstream or inlet portion of the catalytic system operates at a lower temperature than does the downstream portion. Consequently, a more active catalyst but one which decomposes at relatively low temperatures (such as a PdO catalyst) may be used in the cooler, upstream igniter zone whereas a catalyst, such as a binary oxide catalyst described above, which is comparatively more resistant to high temperature may be used in the downstream or higher temperature promoter zone of the catalyst. Since the promoter zone catalyst is contacted by the higher temperature gases emerging from the igniter zone, the lower activity of the high temperature resistant catalyst is nonetheless adequate to catalyze combustion of the fuel at the higher temperatures involved.

EXAMPLE 3

A series of catalyst members were tested to determine their relative catalytic activities, thermal stability and regeneration temperature ranges so that they could be disposed in the proper sequence according to the present invention. The catalyst members all comprised Type I monoliths coated with various catalyst materials at a loading of 1.5 g/in$^3$. The configurations of the various test members, which were designated Z1 through Z6, are summarized below in TABLE IIIA.

TABLE IIIA

| Test Catalyst Member | Substrate Type | Washcoat |
|---|---|---|
| Z1 | I | 4 wt. % PdO on alumina |
| Z2 | I | 8 wt. % PdO on alumina |
| Z3 | I | 4 wt. % PdO on ceria-zirconia |
| Z4 | I | 8 wt. % PdO on ceria-zirconia |
| Z5 | I | 8 wt. % PdO; 10% ceria/alumina |
| Z6 | I | 7 wt. % $La_4PdO_7$ with 93 wt. % alumina binder |

The catalyst materials for test members Z1 through Z5 were prepared by impregnating particles of a refractory inorganic oxide support material with a palladium salt solution, and then calcining the impregnated particles to leave palladium oxide deposited thereon. The alumina used as a support material for catalyst members Z1 and Z2 was unimpregnated high surface area alumina. The ceria-zirconia support material used for test members Z3 and Z4 was a co-precipitated ceria-zirconia material comprising about 12% by weight ceria and about 88% by weight zirconia. The co-precipitation results in the ceria being dispersed uniformly throughout the zirconia matrix. This differs from the result attained by impregnation techniques commonly used in the art, which would have left ceria only at the surfaces of the zirconia particles if zirconia particles were impregnated with a solution of a cerium salt. The Z5 catalyst was prepared by co-impregnating alumina particles with a solution of cerium nitrate and palladium nitrate, and then calcining the impregnated alumina particles to produce a material comprising, by weight, 8% palladium as palladium oxide and 10% ceria. The $La_4PdO_7$ of test member Z6 was prepared as described above in Example 1, and was admixed with alumina which acts as a binder. The Z6 catalyst material comprised, by weight, 7% of the $La_4PdO_7$ and 93% alumina. Each of the foregoing catalyst materials were formed into a slurry which was deposited onto a Type I monolith by immersing the monolith into the slurry, drying and calcining the coated monolith, to provide a coating of 1.5 grams catalyst material per cubic inch.

After the carriers were coated, test members Z1 through Z4 were calcined at 500° C. for 2 hours, and then aged at 750° C. for 18 hours. Member Z5 was calcined at 500° C. for 2 hours and then aged at 850° C. for 18 hours. Test member Z6 was calcined at 500° C. for 2 hours and aged at 1100° C. for 18 hours.

Following calcining and aging, the activity of each of the test members was evaluated by flowing a test combustion mixture comprising 1% methane in air at one atmosphere pressure and at a velocity of 20 ft/sec over a catalyst test core one-half inch in length and three quarters of an inch in diameter. The temperature of the inlet stream was raised, and the temperatures at which various degrees of conversion of the methane were attained were noted. If, at a temperature of 700° C., the desired rate of conversion was not achieved, the actual conversion rate attained at that temperature is stated in parenthesis. The results are set forth below in TABLE IIIB.

TABLE IIIB

| Catalyst | Temp. °C. @ % $CH_4$ Conversion | | | | | |
|---|---|---|---|---|---|---|
| Member | 10% | 20% | 30% | 40% | >40% | |
| Z1 | 405° C. | 470° C. | 530° C. | 618° C. | 700° C. | (45%) |
| Z2 | 340 | 370 | 403 | 463 | 592 | (50%) |
| Z3 | 388 | 462 | 550 | 658 | 700 | (43%) |
| Z4 | 373 | 422 | 492 | 584 | 700 | (48%) |
| Z5 | 375 | 401 | 462 | 590 | 700 | (42%) |
| Z6 | 602 | 700 | — | — | — | |

The data of TABLE IIIB indicate that any of the catalyst members Z1–Z6 may be selected in a prescribed sequence as an igniter or promoter catalyst in accordance with the present invention. In the following sequence, a first listed catalyst may serve as an igniter catalyst for any subsequently-listed catalyst: Z2, Z4 or Z5 (Z4 and Z5 are approximately equivalent), Z3, Z1, Z6. The catalysts are listed in descending order of relative igniter catalyst capability. Thus, in accordance with the present invention, catalyst Z2 could serve as an igniter catalyst with any of the subsequently listed catalysts serving as a promoter catalyst. Similarly, catalysts Z4 or Z5 could serve as the igniter catalyst with any of catalysts Z3, Z1 or Z6 serving as the promoter catalyst, and so on.

In addition, the catalyst material of catalyst members Z1 through Z6 were evaluated to determine their decomposition and regeneration temperature ranges. The results are set forth below in TABLE IIIC.

TABLE IIIC

| Catalyst Member | Td °C. | Tr °C. |
|---|---|---|
| Z1 | 802–891 | 25–640 |
| Z2 | 812–887 | 25–650 |
| Z3 | 823–878 | 25–687 |
| Z4 | 833–879 | 25–708 |
| Z5 | 823–970 | 25–738 |
| Z6 | 1300–1350 | 25–767 |

The data of TABLE IIIC indicate that catalyst members Z1–Z6 may be chosen as igniter and promter catalysts from the following sequence of increasing thermal stability, i.e., escalating minimum degradation temperatures: Z1, Z2, Z3 or Z5, Z4, Z6. Alternatively, they may be chosen from the following sequence according to escalating regenerating temperature ranges: Z1, Z2, Z3, Z4, Z5, Z6.

EXAMPLE 4

Catalyst beds designated D, S and T, each comprising different catalyst sequences falling within the present invention were prepared and tested. The beds each comprised four segments, each comprising a Type I monolith having 64 cells per cross-sectional square inch (cpsi). Segments 1, 3 and 4 were all 1.5 inches in length whereas segment 2 was 1 inch in length in each bed. Various materials indicated below in TABLE IVA were coated onto the carrier monoliths by immersing the monoliths in slurries containing the catalyst materials, drying and calcining the immersed carriers so that the loading on the monoliths was 1.5 g/in$^3$ in each case. The catalyst materials were prepared or described in the foregoing Examples. The activity, thermal degradation and regeneration temperatures of the catalyst materials used are set forth in Example 3. The configurations of the beds of this example are summarized in the following TABLE IVA. It will be noted that in each of the three cases illustrated in TABLE IVA, segments 3 and 4, which contain no palladium catalysts, are coated with alumina only, and serve as separator bodies which thermally shield catalyzed segments 1 and 2 from the homogeneous reaction zone.

TABLE IVA

| Catalyst Member | Substrate Type, Length | Washcoat |
|---|---|---|
| | Catalyst Bed D | |
| D1 | I 1.5" | 8 wt. % Pd on alumina |
| D2 | I 1" | 8 wt. % Pd; 10% ceria/alumina |
| D3 | I 1.5" | alumina |
| D4 | I 1.5" | alumina |
| | Catalyst Bed S | |
| S1 | I 1.5" | 4 wt. % Pd on alumina |
| S2 | I 1" | 8 wt. % Pd; 10% ceria/alumina |
| S3 | I 1.5" | alumina |
| S4 | I 1.5" | alumina |
| | Catalyst Bed T | |
| T1 | I 1.5" | 8 wt. % Pd on ceria-zirconia |
| T2 | I 1" | 8 wt. % Pd; 10% ceria/alumina |
| T3 | I 1.5" | alumina |
| T4 | I 1.5" | alumina |

Bed D (sequence Z2, Z5) met all the criteria discussed above regarding the sequence of catalyst materials, but bed S (sequence Z1, Z5) only met two of the criteria, since the material on segment S2 is more active than that of segment S1, as reflected in Example III above. Bed T (sequence Z4, Z5) met only the criterion relating to regeneration temperature, since segment T2 begins to degrade at a lower temperature than does T1 and since the relative activities are not distinguishable.

Beds D, S and T were each placed in a combustor to show their efficacy in initiating the combustion of an air-fuel mixture comprising about 4% methane in air at 3 atmospheres pressure. Each bed initiated downstream homogeneous combustion at the inlet temperature, gas stream velocity, and fuel concentration given in TABLE IVB below.

TABLE IVB

| | Ignition Conditions | | | |
|---|---|---|---|---|
| Cat. Bed | Inlet Temp. (°C.) | Init. Vel. (ft/s) | Fuel Conc. Vol. (%) | Extinction Temp. (°C.)/Fuel % |
| D | 487–550 | 50 | 4.1–3.75 | |
| | 530 | 60 | 4.0 | 496/4.0 |
| | 485–495 | 30 | 4.0 | 465–485/4.0 |
| S | 490–530 | 50 | ca. 4.0 | |
| T | 510–525 | 60 | 4.0 | |
| | 512 | 50 | 4.0 | |
| | 550 | 30 | 4.0 | |

EXAMPLE 5

The catalyst bed designated as M was prepared in which igniter catalyst member M1 comprised a catalyst washcoat comprising 4% palladium oxide on a co-formed rare earth metal oxide (i.e., ceria)—zirconia support material, which was coated on a Type I substrate. The preparation of the co-formed ceria-zirconia material is described above in Example 3. Promoter catalyst member M2 and separator body members M3 and M4 were prepared in the same manner as catalyst members D2 (8% Pd; 10% ceria/alumina), D3 and D4 (both alumina on a Type I substrate), respectively. The configuration of bed M is summarized below in TABLE VA.

TABLE VA

| | Catalyst Bed M | |
|---|---|---|
| Catalyst Member | Substrate Type, Length | Washcoat |
| M1 | I 1.5" | 4 wt. % Pd on Ce—Zr—O |
| M2 | I 1" | 8 wt. % Pd; 10% ceria/alumina |
| M3 | I 1.5" | alumina |
| M4 | I 1.5" | alumina |

Bed M met the invention criteria relating to decomposition and regeneration temperatures but not activity, probably because of the greater palladium oxide content on segment M2 compared to segment M1. The bed was tested and was found to ignite a combustion mixture comprising 3.8 to 4.0 percent methane in air at an inlet velocity of 38 to 40 ft/sec at a gas inlet temperature of 407° to 414° C. and a pressure of 3 atmospheres. The exhaust gases contained no detectable carbon monoxide.

EXAMPLE 6

Three beds designated C, E and F were prepared to demonstrate the combination of catalyst sequences in accordance with the present invention with the preferred separator body comprising a Type II substrate. TABLE VIA describes the configurations of the three catalyst beds.

Example 6 in TABLE VIA and VIB shows the efficacy of catalyst sequences in accordance with the present invention for catalyzing the combustion of a gaseous combustion mixture. In addition, Example 6 and its associated TABLES demonstrate the successful use of catalyst substrates in which all the substrates are Type I (catalyst bed C) in which the catalyst substrates are Type I and the separator bodies are Type II substrates (catalyst bed E) and in which the first two catalyst substrates are Type I, and the third catalyst substrate and the separator body are made of a Type II substrate (catalyst bed F). Generally, the catalysts of the present invention disposed on Type I substrates have generated better activity and performance than the catalysts dispersed on Type II substrates. On the other hand, catalysts of the present invention dispersed on the Type II have demonstrated somewhat better durability and resistance to hydrothermal stresses. Copending patent application Ser. No. 08/026,306, filed Mar. 4, 1993, describes and claims specific sequences of Type I and Type II substrates disposed within a single combustor in order to attain certain described advantages. Generally, by utilizing the Type I substrates in the upstream portion of the combustor bed and the Type II substrates in a downstream portion of the combustor bed, enhanced activity is attained for the upstream segment(s) and enhanced durability is attained by the downstream segment(s).

All the Type I substrates in catalyst beds C, E and F had 64 cells per square inch, and all the Type II substrates had 60 cells per square inch. The washcoat loadings on the catalyst members of beds C, E and F was 1.5 g/in$^3$. The bed configurations may be summarized as follows:

TABLE VIA

| Catalyst Member | Substrate Type, Length | Washcoat |
|---|---|---|
| | Catalyst Bed C | |
| C1 | I 1.5" | 8 wt. % Pd on alumina |
| C2 | I 1" | 8 wt. % Pd; 10% ceria/alumina |
| C3 | I 1.5" | 7 wt. % $2La_2O_3$.PdO with 97% alumina binder |
| C4 | I 1.5" | alumina |
| | Catalyst Bed E | |
| E1 | I 1.5" | 8 wt. % Pd on alumina |
| E2 | I 1" | 8 wt. % Pd; 10% ceria/alumina |
| E3 | II 1.5" | alumina |
| E4 | II 1.5" | alumina |
| | Catalyst Bed F | |
| F1 | I 1.5" | 8 wt. % Pd on alumina |
| F2 | I 1" | 8 wt. % Pd; 10% ceria/alumina |
| F3 | II 1.5" | 7 wt. % $2La_2O_3$.PdO with 97% alumina binder |
| F4 | II 1.5" | alumina |

The efficacy of catalyst beds C, E and F were tested by placing them in a combustor to determine their respective initiation temperatures for a 4% methane in air combustion mixture at a pressure of 3 atmospheres. Two evaluations were performed for beds C and E, and three evaluations were made for catalyst F. The results are set forth below in TABLE VIB.

TABLE VIB

| | Ignition Conditions | | | |
|---|---|---|---|---|
| Cat. Bed | Inlet Temp. (°C.) | Init. Vel. (ft/s) | Fuel Conc. Vol. (%) | Extinction Temp. (°C.)/Fuel % |
| C | 480–500 | 50 | 4.0 | 462–480/4.0 |
| | 420 | 30 | 4.0 | |
| E | 512 | 60 | 4.0 | 506/4.0 |
| | 550–578 | 50 | 4.0 | 515–520/4.0 |
| F | 475 | 60 | 4.0 | 452/4.0 |
| | 504–545 | 50 | 4.0 | 487–515/4.0 |
| | 472–477 | 30 | 4.0 | 440/4.0 |

While the invention has been described with reference to particular embodiments thereof, it will be appreciated that numerous variations to the described embodiments will be within the scope of the appended claims.

What is claimed is:

1. A combustor for catalytically promoting thermal combustion of an inlet combustion gas mixture flowed sequentially through an igniter catalyst zone, a promoter catalyst zone, and then a downstream zone of the combustor, the downstream zone providing a homogeneous reaction zone, and the combustor comprising: (i) an igniter catalyst member disposed in the igniter catalyst zone and comprising an igniter carrier having a plurality of gas flow channels extending therethrough and defined by channel walls on which an igniter catalyst composition is carried; and (ii) a promoter catalyst member disposed in the promoter catalyst zone and comprising a promoter carrier having a plurality of gas flow channels extending therethrough and defined by channel walls on which a promoter catalyst composition is carried, the igniter catalyst member and the promoter catalyst member together comprising a combustor catalyst, wherein the igniter catalyst composition and the promoter catalyst composition are capable of being regenerated after thermal deactivation and which is characterized by the promoter catalyst member having a catalyst regeneration temperature range which extends from a temperature higher than, to a temperature lower than, the upper limit of the regeneration temperature range of the igniter catalyst member.

2. The combustor of claim 1 wherein the combustor catalyst is further characterized by at least one of (a) the igniter catalyst member having a higher activity for combustion of the inlet combustion gas mixture than does the promoter catalyst member, and (b) the igniter catalyst member having a lower catalyst deactivation temperature than does the promoter catalyst composition.

3. The combustor of claim 2 wherein the combustor is characterized by both (a) and (b).

4. The combustor of claim 1, claim 2 or claim 3 wherein the igniter catalyst member and the promoter catalyst member each comprises a discrete body and wherein the members are disposed in proximity to each other.

5. The combustor of claim 1, claim 2 or claim 3 wherein the igniter catalyst member and the promoter catalyst member each comprises a discrete body and wherein the members are disposed in mutual abutting contact.

6. The combustor of claim 1 wherein the regeneration temperature of the promoter catalyst member extends from a temperature at least about 10° C. higher, to a temperature at least about 20° C. lower, than the upper limit of the regeneration temperature range of the igniter catalyst member.

7. The combustor of claim 6 wherein the regeneration temperature of the promoter catalyst member extends from a temperature which is at least about 10° C. to 400° C. higher, to a temperature which is at least about 20° C. to 700° C. lower, than the upper limit of the regeneration temperature range of the igniter catalyst member.

8. The combustor of any one of claims 1, 2 or 3 wherein the igniter catalyst composition comprises palladium oxide dispersed on a refractory metal oxide support.

9. The combustor of claim 8 wherein the refractory metal oxide igniter support is selected from the group consisting of one or more of unimpregnated alumina, alumina impregnated with a rare earth metal oxide, unimpregnated zirconia, zirconia impregnated with a rare earth metal oxide, silica, titania and a co-formed rare earth metal oxide-zirconia.

10. The combustor of claim 9 wherein the refractory metal oxide support comprises unimpregnated alumina.

11. The combustor of claim 8 wherein the igniter catalyst member comprises two or more discrete bodies of igniter carrier.

12. The combustor of claim 8 wherein the promoter catalyst composition is selected from the group consisting of one of (A) a first promoter catalyst composition comprising palladium oxide dispersed on a refractory metal oxide promoter support, (B) a second promoter catalyst comprising a combination of (i) the reaction product of palladium oxide and a metal oxide selected from the group consisting of one or more of samaria, lanthana and praseodymia, combined with (ii) a refractory metal oxide binder, and (C) a sequence of (A) and (B) with (A) disposed upstream of (B).

13. The combustor of claim 12 wherein the first refractory metal oxide promoter support comprises alumina impregnated with a rare earth metal oxide and the refractory metal oxide binder of (ii) is selected from the group consisting of one or more of silica, alumina, alumina stabilized with a rare earth metal oxide, titania and zirconia.

14. The combustor of claim 12 wherein the promoter catalyst member is comprised of two or more discrete bodies of the promoter carrier.

15. The combustor of claim 12 wherein the promoter catalyst composition comprises the first promoter catalyst composition.

16. The combustor of claim 15 wherein the first refractory metal oxide promoter support comprises alumina impregnated with a rare earth metal oxide.

17. The combustor of claim 16 wherein the first refractory metal oxide promoter support comprises alumina impregnated with with a rare earth metal oxide selected from the group consisting of one or more of lanthana, ceria and praseodymia.

18. The combustor of claim 12 wherein the igniter catalyst composition comprises palladium oxide dispersed on a refractory metal oxide igniter support.

19. The combustor of claim 18 wherein the promoter catalyst member comprises the first promoter catalyst composition.

20. The combustor of claim 19 wherein the promoter catalyst member is comprised of two or more discrete bodies of the promoter carrier.

21. The combustor of claim 18 wherein the refractory metal oxide igniter support comprises unimpregnated alumina, the refractory metal oxide promoter support comprises alumina impregnated with a rare earth metal oxide, and the refractory metal oxide binder, if present, is selected from the group consisting of one or more of silica, alumina, alumina stabilized with a rare earth metal oxide, titania and zirconia.

* * * * *